United States Patent [19]

Blomgren et al.

[11] 4,274,506

[45] Jun. 23, 1981

[54] NOISE SHIELD

[76] Inventors: Rolf B. J. R. Blomgren, Akerbyvagen 98, S-103 35 Täy; Nils H. Edlund, Nybygget, Sandemar, S-130 54 Dalarö, both of Sweden

[21] Appl. No.: 946,037

[22] Filed: Sep. 26, 1978

[30] Foreign Application Priority Data

Sep. 28, 1977 [SE] Sweden ..... 7710836

[51] Int. Cl.[3] ..... E04B 1/82; E04H 17/00

[52] U.S. Cl. ..... 181/210; 181/286; 181/287; 181/293

[58] Field of Search ..... 181/200–204, 181/207, 208, 210, 224, 284, 286, 287, 290–293

[56] References Cited

U.S. PATENT DOCUMENTS

| | | | |
|---|---|---|---|
| 3,276,539 | 10/1966 | Dear et al. | 181/204 |
| 3,445,975 | 5/1969 | Nelsson | 181/284 |
| 3,630,310 | 12/1971 | Federer | 181/210 |
| 3,656,576 | 4/1972 | Gubela | 181/210 |
| 4,114,725 | 9/1978 | Croasdale | 181/210 |

*Primary Examiner*—L. T. Hix
*Assistant Examiner*—Benjamin R. Fuller
*Attorney, Agent, or Firm*—Birch, Stewart, Kolasch & Birch

[57] ABSTRACT

The present invention relates to a noise shield including a massive shield wall and an attachable absorbent unit on the shield wall. Thus the noise shield can be used with the absorbent unit along the parts of the road where you do not want reflections of the noise which you want to reduce and without absorbent unit along the parts of the road where you just want a reduction of the noise.

The noise shield is constructed of posts, which are anchored in the ground. Between these posts are mounted support beams. The shield wall consists of shield modules. Each shield module consists of a plank panel, which is mounted on a frame, the plank panel functioning to reduce noise. Furthermore, into the cavity of each shield module; an absorbent unit can be inserted therein, which includes a frame and a panel. A noise shield can be constructed along a part of a road by anchoring the posts in the ground, mounting the support beams thereon and placing the prefabricated shield modules between these posts and support beams. Then the noise shield can be completed with absorbent units.

8 Claims, 5 Drawing Figures

NOISE SHIELD

BACKGROUND AND SUMMARY OF THE INVENTION

The present invention relates to an absorbent unit for a wall, especially a noise shield or the like and the noise shield for which the absorbent unit is adapted.

Noise shields which are currently put to use all have disadvantages despite their different designs. Noise shields in the form of earthen ramparts require great space. Shields in the form of wooden planks do not provide the desired acoustic possibilities and, in the form in which they are built today, are expensive in manufacture. Other shields are not aesthetically appealing, and for this reason they are difficult to place in the townscape.

The purpose of the present invention is to obtain a noise shield which is aesthetically appealing and which can be varied within certain limits so that its appearance can be adapted to the surrounding environment for which the shield is intended. Furthermore, the shield shall have such acoustic properties that it really constitutes an effective protection against noise.

According to the invention, this is achieved by means of a noise shield being constructed out of shield modules of wooden panelling, onto which module absorbent units can be mounted. The noise shield according to the invention consists of a wooden wall built up of modules, onto which wall absorbent units can be mounted when necessary. The shield modules and the absorbent units are adapted to each other so as to allow simple assembly. The modules can be built to a desired height, each row being supported by a support beam. If necessary, an absorbent unit can then be mounted onto each module. The absorbent unit consists of a frame onto which a panel is arranged and inside of which an insulating material is situated. Thus, the absorbent unit is a separate unit and is only mounted onto the shield when noise absorption is required. It can also be used on normal walls where some form of improved noise damping is required.

Accordingly, one object of the present invention is to provide a noise shield which is aesthetically appealing and which can be varied in appearance in accordance with the surrounding environment for which the shield is intended.

Another object of the subject invention is to provide a noise shield which provides effective protection against noise.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention is described in more detail below, reference being made to the enclosed drawing which are given by way of illustration only and are not limitative to the present invention, and wherein.

DETAILED DESCRIPTION OF THE INVENTION

Figure 1:
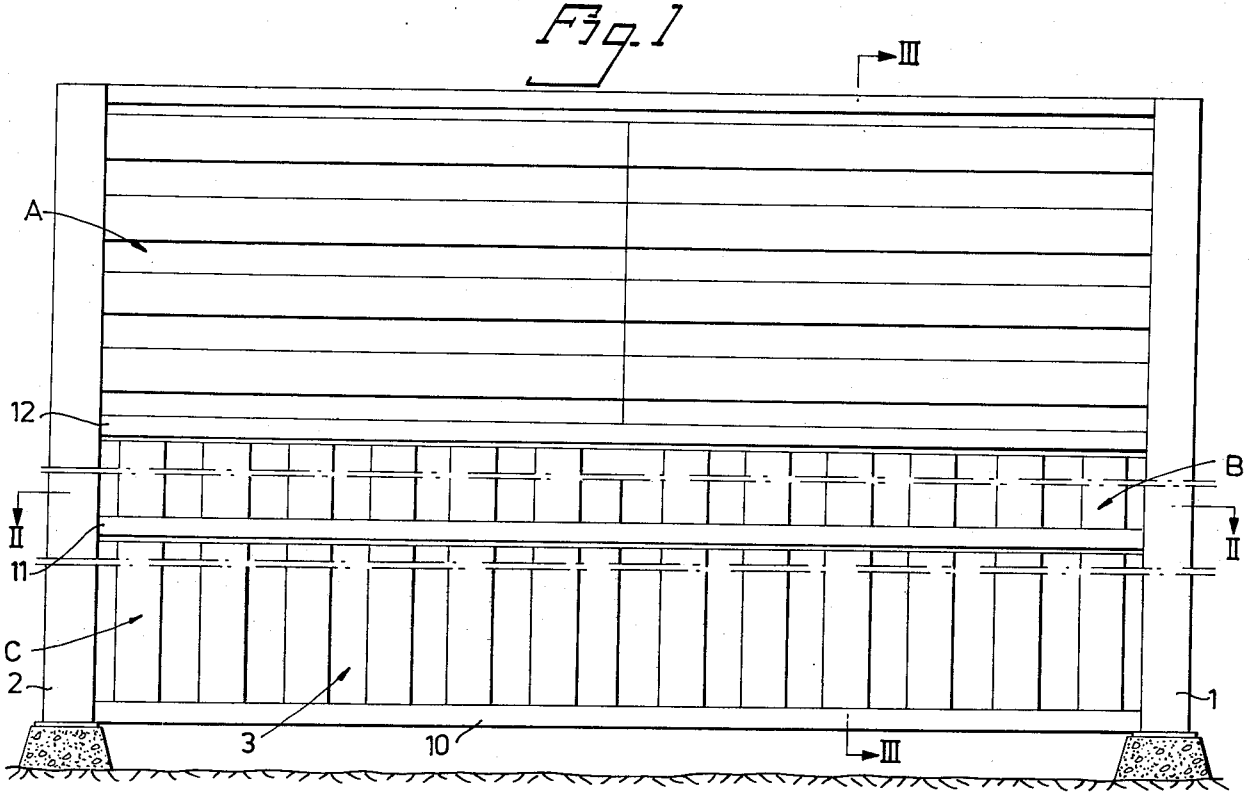
FIG. 1 is a view from the front of one side of a noise shield according to the present invention.

FIG. 1 illustrates a longitudinal section of the noise shield. Said shield is, in principle, constructed in the same manner along the entire length of the shield, aside from minor adaptions to ground conditions. Thus, only one section shall be dealt with in the following description.

Each longitudinal section consists of two posts 1, 2 which are anchored in the ground in a normal manner. Depending on the ground, said anchoring is carried out in a suitable manner which is not dealt with here as it is of no importance as regards the invention. The shield modules 3 (also indicated as A, B, and C in FIG. 1) constructed in the form of prefabricated modules can then be positioned between said posts. In the embodiment illustrated in FIG. 1, six shield modules 3 are arranged between the posts 1,2. Each row of shield modules are placed on support beams 10, 11, 12 which are inserted into and anchored in the posts 1, 2. The posts 1, 2 are suitably made out of steel and consists of so called H-beams.

The support beams 10, 11, 12 are suitably made out of aluminium or steel and have the shape of a so called z-steel. The distance between the posts 1, 2, their height and the length and width of the shield modules have specific dimensions relative each other. The width of each shield member is thus one module unit—which shall be denoted M below—and the length of each shield member is 1.5 M. The distance between the posts is three M and their height is preferably selected to be 1 M, 1.5 M, 2 M, 2.5 M or 3 M depending on the required shielding effect. In the embodiment illustrated in FIG. 1, the posts have a height of 3 M and the shield modules are arranged in three rows, two reclining modules in each row. The module unit M is preferably selected to be 1,2 meters. A U-shaped beam 15 is placed above the uppermost row of shield modules, said beam having the purpose of protecting the shield modules from rain.

Figure 2:
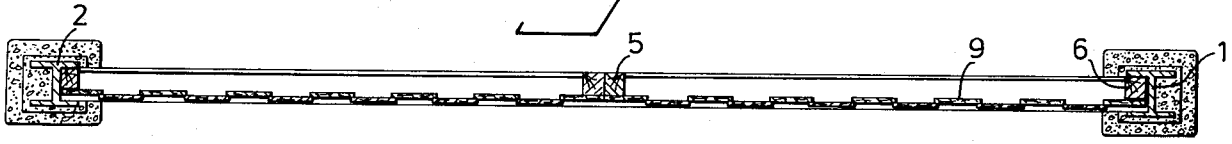
FIG. 2 shows a section of the noise shield along the line II—II in FIG. 1.
Figure 3:
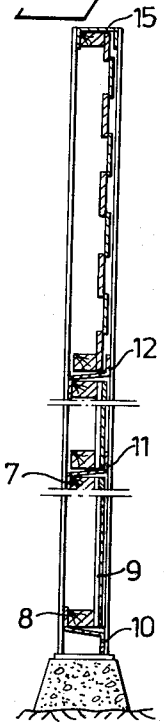
FIG. 3 shows a section of the noise shield along line III—III in FIG. 1.

Each shield module consists of a frame in which are included two transverse support members 5, 6 and two longitudinal support members 7, 8 (c f FIGS. 2 and 3). A panel 9, preferably of planks, is then mounted onto said frame. Said plank panel can be constructed as a so called lock panel, that is, every other plank partially overlaps the two adjacent planks. The planks can be mounted in the longitudinal direction of the frame or in its transverse direction. However, it is also feasable for them to form an angle to the longitudinal support member of the frame, suitably an angle of 45°.

The shield modules are then placed between the posts, each row of shield modules resting upon a support beam 10, 11 or 12. The support beams 10, 11, 12 are partly intended to support the shield modules and partly intended to fill the gap which can arise between an overlying and underlying row of shield modules. It is very essential for the noise damping effect of the shield that no gaps exist between the different shield modules. The shield modules are attached to the support beams 10, 11, 12 in a suitable manner, for example, by means of screws.

The successive shield modules in each row are screwed together, whereby an acceptable compactness is achieved. The gap which arises between the ground level and the bottom support beam 10 is suitably covered by means of a suitable filling material being laid against the downwardly-directed flange of said beam 10.

The noise shield is constructed with the help of prefabricated shield modules prepared for assembly when they are delivered to the construction site. Thus, only anchoring and raising of the post 1, 2 have to be carried out at the construction site, after which the support beams 10, 11, 12, the shield modules 3 and the protective beam 15 are positioned and connected to each other and, when necessary, to the posts 1, 2. This construction of the shield provides a shield which, in principle, consists of a simple plank panel. Tests have shown that this arrangement provides a fully sufficient damping effect. Field measurements have shown that plank panels having a thickness of 22 mm. provide a noise reduction of approximately 18 dB A. A shield made out of a uniformly massive material in this manner does, however, create a certain reflection of noise. In certain environments, this can be unsuitable.

Figure 5:
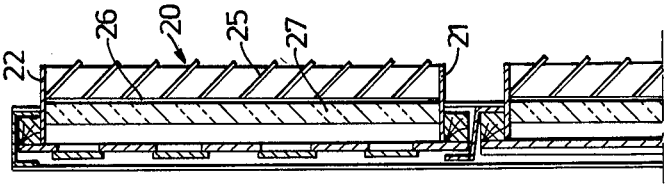
FIG. 5 shows a section along line V—V in FIG. 4.
Figure 4:
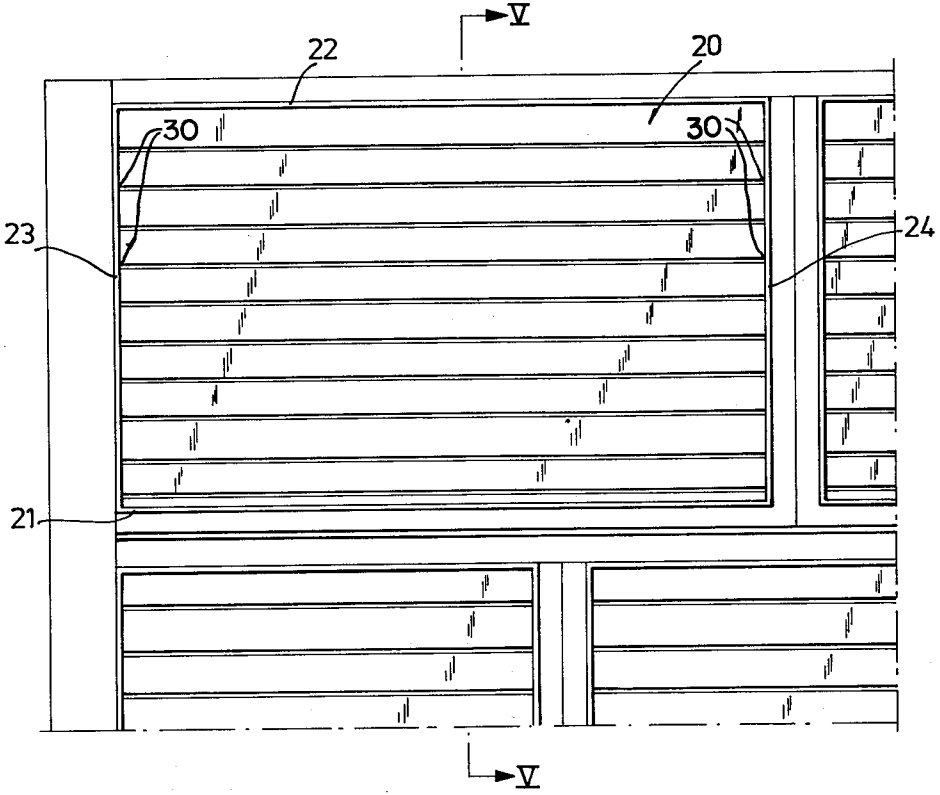
FIG. 4 illustrates a view of the other side of the noise shield, the absorbent units inserted into the modules.

In such cases, the noise shield can be equipped with an absorbent unit which is referred to in its entirety by reference numeral 20 in FIGS. 4 and 5. Said absorbent unit 20 is intended to be a supplement to the noise shield when it is desired that said shield shall have a noise-absorbing effect. The absorbent unit 20 is built up about a frame consisting of two longitudinal beams 21, 22 and two transverse beams 23, 24. The noise-absorbent material 27 is placed inside said frame. Said material can consist of rockwool matting, wood-wool matting or the like. Likewise, a protective net 26 and a protective panel 25 are arranged on one side of the noise absorbing material inside said frame. The protective panel 25 can consist of horizontal inclined spaced planks. In this manner, one obtains a panel which is open but still protects the insulation from rain and dirt. Two embodiments of the absorbent unit should exist, one in which the panel 25 is parallel to the shorter beams 23, 24 in the frame, and one in which the panel 25 is parallel to the two longer beams 21, 22 in the frame. This is done so that the absorbent unit shall be able to be assembled so that the planks of the protective panel 25 will slope outwards and downwards irrespective out of the direction in which the shield modules and the absorbent unit are assembled. The outer dimensions of the frame of the absorbent unit 20 are selected in such a manner that they correspond to the inner dimensions of the frame of the shield module 3. An absorbent unit 20 can be mounted onto a shield module 3 in a simple manner by means of the absorbent unit being inserted inside the frame 3 of the shield module and attached to the same in a suitable manner, for instance, by means of screws.

The absorbent units are also intended to consist of units ready to be assembled at a construction site. The construction site can be a noise shield or a building requiring extra insulation in order to obtain noise absorption.

In order to obtain a rational manufacture and a minimum consumption of wood, the absorbent unit is designed in the simplest feasable manner. The short ends of the panel 25 are fixed to the frame consisting of two longitudinal beams 21, 22, and two transverse beams 23, 24 by means of a joint fastener 30. Said fastener is designed so that it is attached to the inside of the two beams against which the ends of the panel planks abut and consists substantially of a metal plate from which flanges are upwardly folded. Said flanges are intended to support the individual planks of the panel 25 so that said planks have a certain incline and can easily be mounted onto the frame.

Figure 7:
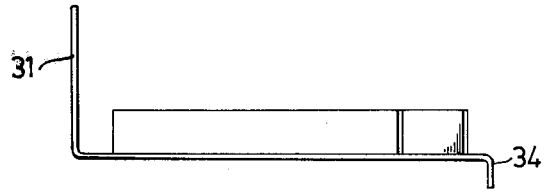
FIG. 7 shows a section of the joint fastener along line VII—VII in FIG. 6.
Figure 6:
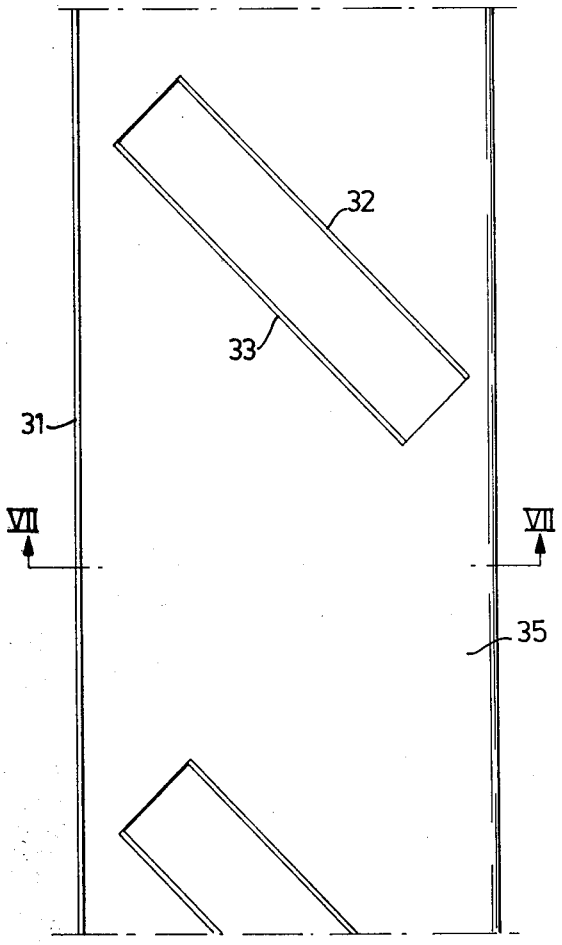
FIG. 6 is a front view of the joint fastener which fixes the absorbent unit panel to its frame.

The joint fastener is illustrated as seen from the front in FIG. 6, having a bottom plate 35 and a flange 31 against which the planks of the panel are intended to abut. Angularly set flanges 32, 33 are folded up from the bottom plate 35, said flanges being intended to support a plank attached to the same in a suitable manner. Attachment means 34 are also arranged on said bottom plate 35. Said attachment means are situated on the edge of the bottom plate directly opposite the flange 31 and are intended to penetrate into the beam upon which the joint fastener 30 is to be arranged. The attachment means 34 can be designed in a manner suitable for this purpose, for instance, as shown in FIG. 7, where they have the form of triangular pins manufactured as an integral part of the bottom plate and projecting at spaced intervals along the edge of and perpendicular to the same. Furthermore, it is also feasable that the bottom plate 35 be fixed by means of being nailed to the underlying beam to which the panel planks shall be fixed.

Naturally, the joint fastener described here can also be used in other types of shield protection where the intention is to assemble a similar type of panel consisting of horizontal inclined planks, for example, cupboard doors and window shutters.

Only one longitudinal section of the noise shield has been described in the embodiment of the invention presented here. The noise shield shall consist of a number of such sections extending along the stretch of highway for which noise protection is desired. Thus, each post will constitute a support for two adjacent sections. Said sections can be vertically displaced relative each other and angled in order to adapt the noise shield to ground formations and bends in the road.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A noise shield adapted for mounting on a piece of ground for the reduction of noise produced from external sources, comprising:

at least two posts anchored into said ground;

a plurality of support beams mounted on said posts and extending between said at least two posts in a substantially perpendicular orientation therewith; and shielding means supported by said plurality of support beams for providing a shield against said noise being generated from said external sources, said shielding means further comprising a plurality of shield module means assembled together to form a plurality of row-like shields, each of said plurality of row-like shields being supported by one of said plurality of support beams, all of said plurality of row-like shields collectively constituting said shielding means, each of said plurality of shield module means including a noise absorbent means removably inserted into each of said shield module means for absorbing said noise being generated from said external sources, the removable noise absorbent means including, frame means for providing structural support for said noise absorbent means, a noise absorbent material supported within said frame means, and a plurality of substantially parallel planks supported within said frame means and positioned adjacent to said noise absorbent material within said frame means.

2. A noise shield in accordance with claim 1 wherein said noise absorbent means further includes:

protective net means supported within said frame means and interposed between said noise absorbent material and said plurality of substantially parallel planks.

3. A noise shield in accordance with claim 2, wherein each of said plurality of substantially parallel planks are mounted at an angle relative to the plane of said frame means, said plurality of substantially parallel planks forming a protective panel means for providing mechanical protection to said noise absorbent means and for allowing noise to pass therethrough.

4. A noise shield in accordance with claim 3, wherein said noise absorbent means further includes a plurality of joint fastening means for securely fastening each of said plurality of substantially parallel planks to said frame means, said joint fastening means including, a plate means attached to said vertical frame structural supports, flange means attached to said plate means in a substantially perpendicular orientation therewith, said flange means including, a first flange attached to one end of said plate means, extending in one direction relative thereto, and in a substantially perpendicular orientation therewith, a second flange attached to the other end of said plate means, extending in an opposite direction relative to the direction of extension of said first flange, and in a substantially perpendicular orientation with respect to said plate means, and third and fourth flanges secured to a central portion of said plate means in a substantially parallel relation relative to each other, said third and fourth flanges being oriented substantially perpendicular to said plate means and being secured to said plate means at an inclined angular orientation relative to the transverse axis of said plate means.

5. A noise shield in accordance with claim 2, wherein the length of each shield module means is 1.5 times the width of each of said shield module means.

6. A noise shield in accordance with claims 5, wherein the distance between said at least two posts is three times the width of each of said shield module means.

7. A noise shield in accordance with claim 2, wherein said shield modules means are arranged in a plurality of rows, each of the rows of said shield module means being supported by one of said plurality of support beams.

8. A noise shield in accordance with claim 7, wherein said plurality of rows of shield module means comprises:

a top row and at least one lowermost row of shield module means relative to said top row; and wherein said noise shield further comprises protective plate means covering the uppermost portion of said shield module means in said top row for protectively covering the uppermost portion of the top row of said shield module means.

* * * * *